US005509392A

United States Patent [19]

Schmitz

[11] Patent Number: 5,509,392

[45] Date of Patent: Apr. 23, 1996

[54] ANTI-VAPOR LOCK FUEL SYSTEM

[76] Inventor: John J. Schmitz, 19616 Salisbury, St. Clair Shores, Macomb County, Mich. 48080

[21] Appl. No.: 431,176

[22] Filed: Apr. 28, 1995

[51] Int. Cl.[6] ..... F02M 37/04

[52] U.S. Cl. ..... 123/516; 123/541; 123/514

[58] Field of Search ..... 123/516, 541, 123/514, 41.31, 456, 497

[56] References Cited

U.S. PATENT DOCUMENTS

| | | | |
|---|---|---|---|
| 3,477,238 | 11/1969 | Race | 123/541 |
| 3,945,353 | 3/1976 | Dreisin | 123/41.31 |
| 3,973,536 | 8/1976 | Zelders | 123/541 |
| 4,187,813 | 2/1980 | Stumpp | 123/541 |
| 4,872,438 | 10/1989 | Ausiello | 123/541 |
| 4,926,829 | 5/1990 | Tuckey | 123/41.31 |
| 5,044,339 | 9/1991 | UdoHafner | 123/41.31 |

FOREIGN PATENT DOCUMENTS

| | | | |
|---|---|---|---|
| 0059303 | 9/1982 | European Pat. Off. | 123/541 |

*Primary Examiner*—Carl S. Miller

*Attorney, Agent, or Firm*—Peter A. Taucher; Gail S. Soderling

[57] ABSTRACT

An anti-lock system for preventing vapor lock is disclosed. It has a temperature sensor which controls the vehicle fuel pump to circulate liquid fuel through the majority of the fuel system when the under hood temperature is above a certain level to maintain liquidity at all times and prevent the formation of vapor in the fuel system.

1 Claim, 1 Drawing Sheet

ANTI– VAPOR LOCK FUEL SYSTEM

GOVERNMENT INTEREST

The invention described herein may be manufactured, used and licensed by or for the Government for governmental purposes without payment to me of any royalty.

BACKGROUND OF THE INVENTION

1. Field of the Invention

In one aspect this invention relates to fuel control systems for internal combustion engines. In yet a further aspect this invention relates to a fuel pump system which can recycle fuel to provide anti-vapor lock protection.

2. Prior Art

Normal fuel pump designs provide for fuel to be drawn from the fuel tank which acts as a reservoir and directs the liquid fuel to a device which atomizes the fuel and mixes the fuel with a quantity of air to make a combustible mixture suitable for burning in an internal combustion engine. Under certain circumstances, the fuel in the fuel line is vaporized by the heat present in the engine compartment. When this happens, the fuel pump will not deliver liquid fuel to the fuel atomizing device and the engine will not operate properly.

The vapor lock condition situation generally occurs when the vehicle has been operated for period of time raising the engine compartment temperature to a level which will promote fuel vaporization in the fuel lines physically present in the engine compartment. When vapor lock occurs, the vehicle can not be restarted until the fuel reliquifies or the fuel pump can force liquid fuel to the fuel atomizer. This can be several minutes or even longer. In a civilian application this is extremely irritating and wastes time. In a military situation the danger of an inoperable vehicle is readily apparent.

BRIEF SUMMARY OF THE INVENTION

The present invention solves the problems of the prior art and avoids vapor lock by providing a fuel supply system which maintains the fuel in the supply lines in a liquid state at all times. The fuel system includes a fuel tank containing the liquid fuel suitable for use by the internal combustion engine used in the vehicle. An electrically driven fuel pump is used to draw fuel from the tank to the inlet port of the fuel pump being fluidly connected to the fuel tank. The fuel pump draws liquid fuel from the fuel tank and pumps fuel under pressure into a fuel line from a discharge port. The fuel line delivers the pressurized fluid to a fuel atomizer of the internal combustion engine.

The present invention has a recycle line with a first end attached to the fuel line at a point near the fuel atomizer and a second end attached to the fuel tank. the recycle line provides an alternate pattern for fuel flow as described hereinafter. The fuel pump is controlled by an engine control unit which controls the fuel pump and associated engine functions. The engine control unit provides power from the vehicle battery system to the fuel pump to provide a pumping action and cause fuel flow the power passing through a switch 17.

The present invention has a temperature sensor which is associated with the engine compartment In the vicinity of the fuel pump and fuel Lines to measure the temperature to which the fuel line and thereby the liquid fuel is being exposed. The temperature sensor will have associated logic circuitry measuring the temperature of the engine compartment. The temperature sensor will compare the measured temperature against a preset empirically determined minimum temperature at which the possibility of vapor lock is expected to reach an unacceptable level. When the predetermined temperature is reached, a logic circuit associated with the temperature sensor will turn on the fuel pump. The logic circuit unit will cause the fuel pump to circulate fuel from the tank through the fuel line and recycle line to maintain a constant flow of liquid fuel in the fuel line until the sensor indicates the temperature has fallen to a level where vapor lock has a low probability at which time the logic will cause the fuel pump to cease pumping.

BRIEF DESCRIPTION OF THE DRAWING

In the accompanying drawing:

The FIGURE is a block diagram showing one possible structure of this invention.

DETAILED DESCRIPTION OF PREFERRED EMBODIMENTS

Figure 1:
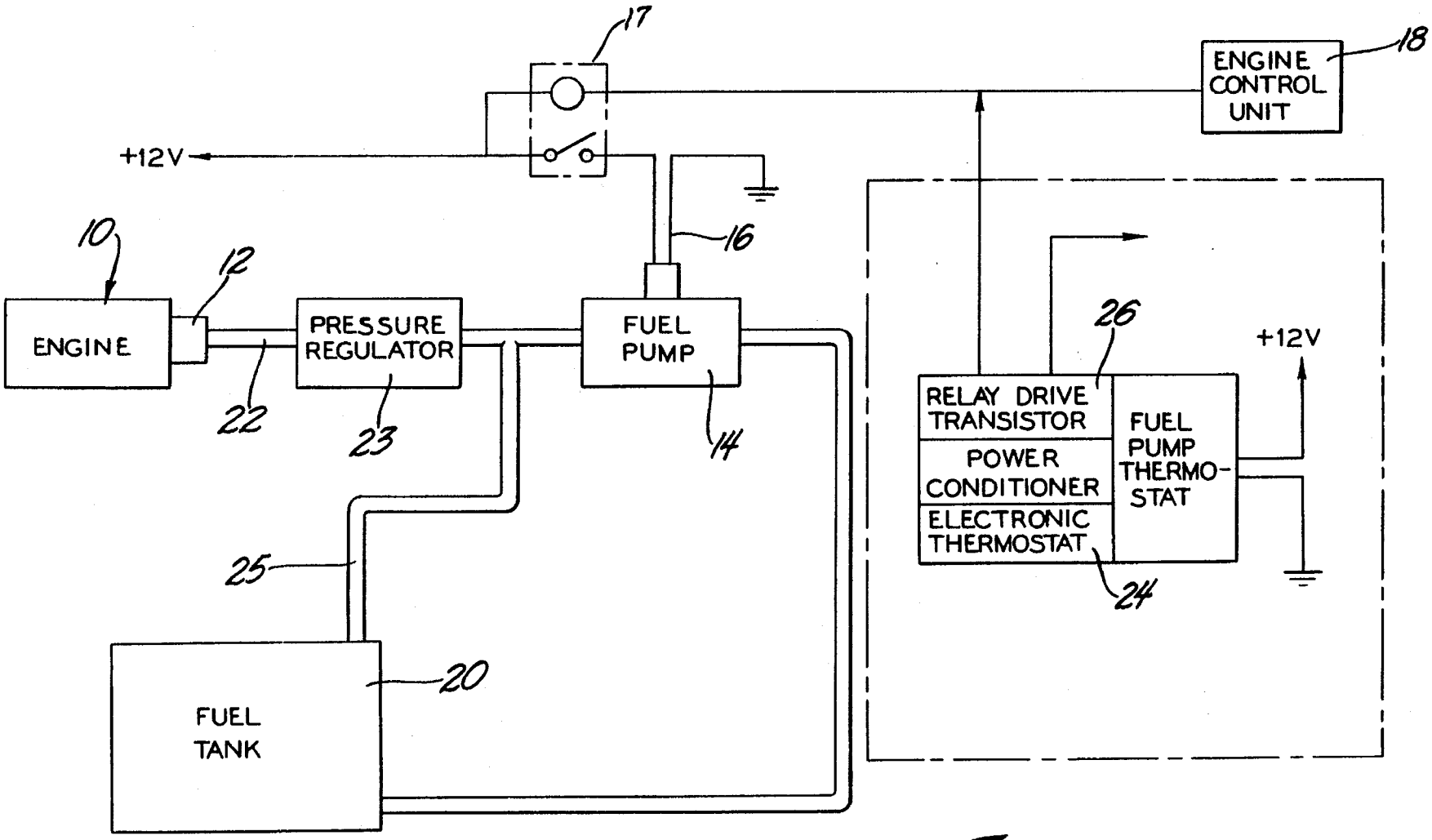

Referring to the accompanying drawing wherein all components are represented as functional blocks, an internal combustion engine 10 is shown. The engine has a fuel atomizer 12 which is designed to take liquid fuel and mix it with air so as to form a combustible mixture useful in the engine. The fuel atomizer can be a carburetor or fuel injection system, both types of systems being useful in the practice of this invention. The fuel is supplied under pressure by means of a fuel pump 14 which draws its current from the vehicle electrical system via connection 16. The power is controlled by means of an engine control unit 18 such units being common to modern vehicles and being programmed to receive a variety of input signals on vehicle operating conditions and control a variety of engine functions including fuel delivery. The fuel pump 14 draws liquid fuel from the fuel tank 20 the fuel entering the pump's inlet and exiting the pump at an outlet into fuel line 22 which is in turn connected to the atomizer 12. A pressure regulator 23 is located between the fuel atomizer 12 and the engine 10. When the pressure in the regulator exceeds its fuel flow pressure the excess fuel is returned to the fuel tank 20 via a fuel return line 25 when the vehicle is not being driven, all the fuel pumped to maintain fuel liquidity will be returned to tank.

A temperature sensor 24 will be located in the engine compartment of the vehicle not shown The sensor can be of various types, such as a thermocouple, capable of measuring the temperature of the engine compartment and generating a signal which can be used as the signal that action is necessary. The temperature sensor 24 will have associated logic circuitry which will have an empirically determined critical temperature above which the possibility of vapor lock is sufficiently great that action is necessary. When the critical temperature is sensed, the logic circuitry will provide power to the fuel pump to move liquid fuel through the fuel line to maintain the fuel in a liquid condition. When the temperature sensed falls below the critical temperature or the engine is restarted, the power will be turned off.

Various modifications and alterations will become apparent to those skilled in the art with out departing from the scope and spirit of this invention and it is understood that this invention is not limited to the illustrative embodiments set forth above.

What is claimed is:

1. An anti-vapor lock fuel supply system for a vehicle powered by an internal combustion engine having a fuel atomizer, comprising:

a fuel tank containing a liquid fuel for use by the internal combustion engine;

an electrically driven fuel pump having an inlet port fluidly connected to the fuel tank from whence it draws liquid fuel, and a discharge port fluidly connected to a fuel line attached to the fuel atomizer of the internal combustion engine, a recycle line having a first end attached to the fuel line at a point near the fuel atomizer, between the fuel atomizer and the fuel pump and a second end attached to the fuel tank;

an engine control unit associated with the internal combustion engine, the engine control being adapted to control the power to the fuel pump to provide a pumping action;

a temperature sensor associated with the engine compartment, the sensor measuring the temperature of the engine compartment, the temperature sensor having associated logic circuitry to signal when the engine compartment temperature has risen above a predetermined critical temperature to a point where vapor lock has become probable, the logic signaling and activating the engine control unit when the temperature has risen above the critical temperature to cause the fuel pump to circulate fuel from the tank through the fuel line and recycle line to maintain a constant flow of liquid fuel in the fuel line until the sensor indicates the temperature has fallen to a level where vapor lock has a low probability at which time the logic signals the engine control unit to cease pumping.

* * * * *